US008272170B2

(12) United States Patent
Argentina

(10) Patent No.: US 8,272,170 B2
(45) Date of Patent: Sep. 25, 2012

(54) DRAIN BOX WITH DOWNSPOUT GUARD AND METHOD OF MAKING SAME

(75) Inventor: Gregg Argentina, Philadelphia, PA (US)

(73) Assignee: Paraino, Inc., Philadelphia, PA (US)

( * ) Notice: Subject to any disclaimer, the term of this patent is extended or adjusted under 35 U.S.C. 154(b) by 294 days.

(21) Appl. No.: 12/708,629

(22) Filed: Feb. 19, 2010

(65) Prior Publication Data

US 2011/0203191 A1 Aug. 25, 2011

(51) Int. Cl.
*E04D 13/00* (2006.01)

(52) U.S. Cl. ..... 52/12; 52/11

(58) Field of Classification Search ..... 52/11, 12, 52/14, 16, 745.2; 210/162
See application file for complete search history.

(56) References Cited

U.S. PATENT DOCUMENTS

| | | | | |
|---|---|---|---|---|
| 2,994,433 | A | 8/1961 | Sandin | |
| 3,357,561 | A | 12/1967 | Thompson et al. | |
| 3,713,539 | A | 1/1973 | Thompson et al. | |
| 4,472,274 | A * | 9/1984 | Williams | 210/163 |
| 4,652,365 | A | 3/1987 | Ebeling | |
| 5,167,579 | A | 12/1992 | Rotter | |
| 5,469,670 | A | 11/1995 | Thaler | |
| 5,486,287 | A | 1/1996 | Murphy et al. | |
| 5,526,613 | A | 6/1996 | Simeone, Jr. | |
| 5,735,091 | A | 4/1998 | Hawkins et al. | |
| 6,219,972 | B1 * | 4/2001 | Zusy | 52/12 |
| 6,497,816 | B2 * | 12/2002 | Naddy | 210/162 |
| 7,200,969 | B2 | 4/2007 | Rotter | |
| 7,208,081 | B2 | 4/2007 | Jones | |
| 7,407,574 | B2 | 8/2008 | Robinson | |
| 7,550,077 | B2 | 6/2009 | Graf | |
| 2003/0141231 | A1 | 7/2003 | Rattenbury et al. | |
| 2006/0191208 | A1 | 8/2006 | MacIntyre | |
| 2006/0278573 | A1 | 12/2006 | Robinson | |
| 2008/0296211 | A1 | 12/2008 | Swan | |

* cited by examiner

*Primary Examiner* — Basil Katcheves
(74) *Attorney, Agent, or Firm* — Panitch Schwarze Belisario & Nadel LLP

(57) ABSTRACT

A drain box includes a housing having a first portion and a second portion. The first portion generally defines a cavity and has a bottom wall that extends below a plane defined by a generally flat roof of a building. The second portion is laterally adjacent to the first portion. The second portion has a bottom wall that extends along a portion the roof. A downspout guard is located within the cavity. The downspout guard includes a water-porous material located entirely within the first portion of the housing.

16 Claims, 9 Drawing Sheets

DRAIN BOX WITH DOWNSPOUT GUARD AND METHOD OF MAKING SAME

BACKGROUND OF THE INVENTION

The present invention relates generally to a drain box and, more particularly, to a drain box for a roof of a building designed to improve drainage of rain water, for example, to and through a downspout.

It is well known that a generally flat or slightly sloped roof of a building or other structure is particularly susceptible to puddling or pooling of rain water. Such occurrences are relatively common, particularly with commercial and industrial buildings, as well as domestic structures, such as townhomes or row homes, and often cause leaks into the interior of the buildings. Although generally flat-roof buildings may include a downspout, which may be in the form of a cylindrical tube or a tube having a square or rectangular cross-section having a top end or opening located at or near the roof surface and a bottom end or opening that extends toward the bottom of the building, the downspout can become easily clogged with debris, such as leaves and twigs, for example, or other objects, such as balls, for example.

Various devices are used to improve the drainage of rain water to and through the downspout. For example, U.S. Pat. No. 5,735,091 to Hawkins et al. discloses a metal dome-shaped "cap" or raised cage which can be placed over the top end of the downspout. The caps are designed to permit the flow of rain water to the top end of the downspout, but block the flow of leaves and twigs, for example, into the downspout. However, leaves, twigs or other debris often clog the cap, thus defeating the purpose of the cap.

Referring to FIGS. 1, 9 and 11, another prior art device used to improve drainage on a flat or generally flat roof 50 is generally referred to as a "drain box" 210. The prior art drain box 210 is a generally elongated, rectangular structure having an open top, a first portion 212*a* designed to be placed over or around a top end 42*a* of a downspout 42 and a second portion 212*b* designed to initially receive the water to be drained. The second portion 212*b* extends along a portion of the roof 50 away from the top end 42*a* of the downspout 42. A bottom wall 224 of the first portion 212*a* extends generally parallel to and coplanar with a bottom wall 226 of the second portion 212*b*. Although the drain box 210 is designed to provide an open/clear passageway to the top end 42*a* of the downspout 42, at least the first portion 212*a* of the drain box 210 often becomes clogged with any or all of leaves, twigs or other debris after a heavy rainstorm, for example, or simply over an extended period of time, thus preventing water from draining from the roof to and through the downspout 42.

As seen in FIGS. 9-12 and 16, generally flat-roof buildings 52, such as any or all of commercial or industrial buildings or townhouses or row homes, typically include one or more firewalls, parapet walls or property walls 58 that extend upwardly a predetermined distance beyond the level of the roof 50 at or around the perimeter thereof. The parapet walls 58 may extend 30 inches above the level of the roof 50, depending on the building codes of the particular jurisdiction. The parapet walls 58 help to direct rain water, for example, toward at least one section of the roof 50 such that rain water can flow directly off of the roof 50 or toward or to a downspout 42, if provided.

However, using a conventional drain box 210 on a roof 50 that includes parapet walls 58 generally surrounding the perimeter thereof can be problematic. For example, if any or typically all of leaves, twigs or other debris, for example, clogs or blocks the first portion 212*a* of the drain box 210, the rain water can quickly accumulate on the roof 50, since the parapet walls 58 generally prevent the rain water from flowing off of the roof 50 until the water level reaches the necessary height to flow over the parapet walls 58 (i.e., thirty inches) or a front end wall 216*a* of the drain box 210. This relatively large accumulation of rain water may, particularly over time, result in a weight that can literally crush portions of the roof 50, causing at least portions of the roof 50 to cave into the interior of the building 52.

Therefore, it would be desirable to create a device that eliminates, or at least reduce, the above-identified deficiencies. The present invention does so.

BRIEF SUMMARY OF THE INVENTION

Briefly stated, one aspect of the present invention is directed to a drain box including a housing having a first side wall and an opposing second side wall. Each of a first end wall and an opposing second end wall extends generally orthogonally between the first and second side walls of the housing. Each end wall has a top edge and an opposing bottom edge. A bottom wall extends generally orthogonally between the first and second side walls of the housing. The bottom wall has a first section extending from the bottom edge of the second end wall and a second section extending from the top edge of the second end wall. The end walls and the first section of the bottom wall in combination with the at least a segment of each side wall generally define a cavity. A drainpipe portion extends downwardly generally orthogonally away from the first section of the bottom wall. A downspout guard is located within the cavity.

In another aspect, the present invention is directed to a drain box including a housing having a first portion and a second portion. The first portion generally defines a cavity and includes a flange that extends generally orthogonally inwardly into an interior of the first portion. The first portion is sized and shaped to be placed above or around at least a portion of a downspout. The second portion is laterally adjacent to the first portion. The second portion has a bottom wall that extends along a portion of the generally flat roof of a building. A downspout guard is located within the cavity and is formed of a water-porous material located entirely within the first portion of the housing. At least a portion of the water-porous material is located beneath the flange.

In yet another aspect, the present invention is directed to a method of making a drain box including forming a housing having a first side wall and an opposing second side wall. The first end wall and opposing second end wall extend generally orthogonally between the first and second side walls of the housing. Each end wall has a top edge and an opposing bottom edge. A bottom wall extends generally orthogonally between the first and second inside walls of the housing. The bottom wall has a first section extending from the bottom edge of the second end wall and a second section extending from the top edge of the second end wall. The end walls and the first section of the bottom wall in combination with the at least a segment of each side wall generally define a cavity. The method also includes inserting a downspout guard into the cavity.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings two embodiments which are presently preferred. It should be understood, however, that the invention is not limited to the precise arrangements and instrumentalities shown.

In the drawings.

DETAILED DESCRIPTION OF THE INVENTION

Figure 1:
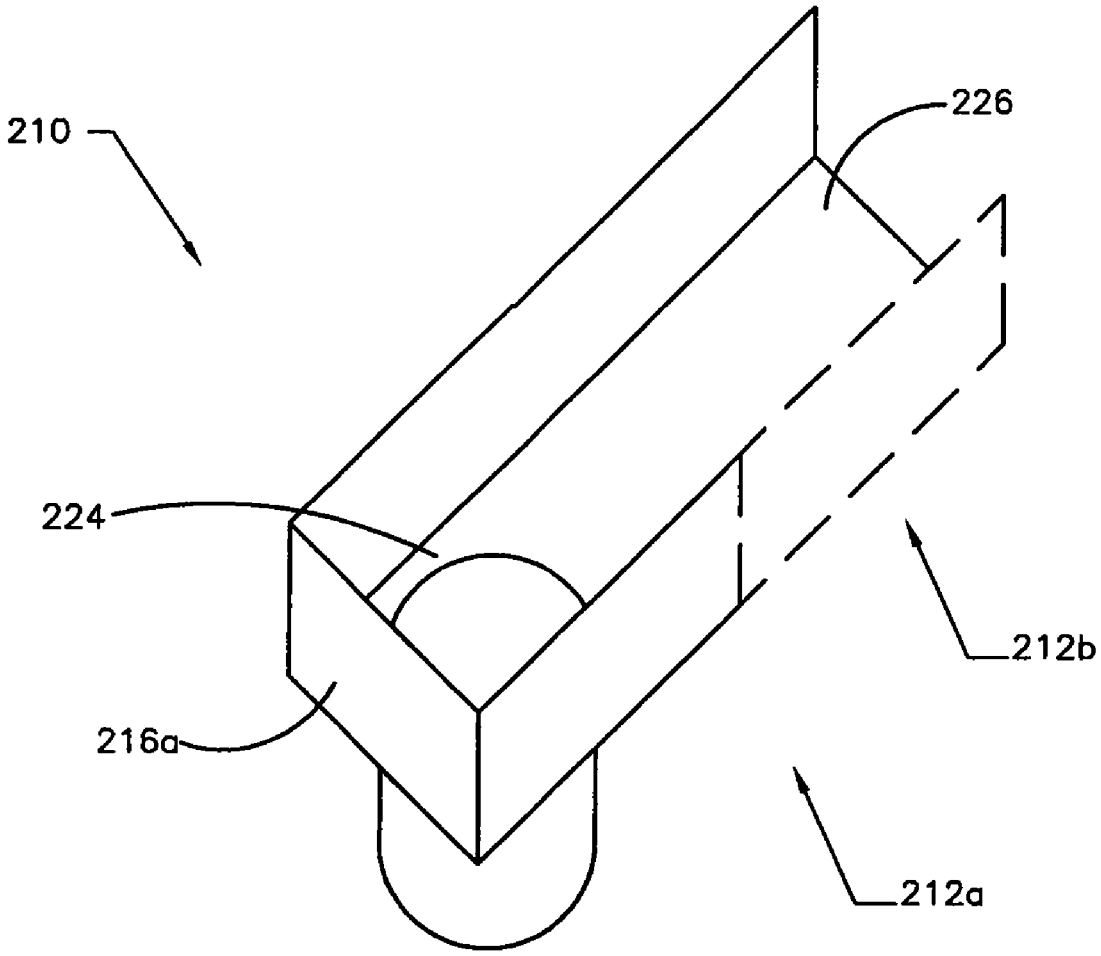
FIG. 1 PRIOR ART
FIG. 1 is a front right isometric view of a drain box according to the prior art.

Certain terminology is used in the following description for convenience only and is not limiting. The words "right," "left," "lower," "bottom," "upper," "top," "front" and "rear" designate directions in the drawings to which reference is made. The words "inwardly" and "outwardly" refer to directions toward and away from, respectively, the geometric center of the drain box, and designated parts thereof, in accordance with the present invention. Unless specifically set forth herein, the terms "a," "an" and "the" are not limited to one element, but instead should be read as meaning "at least one." The terminology includes the words noted above, derivatives thereof and words of similar import.

Referring to the drawings in detail, wherein like numerals indicate like elements throughout the several views, FIGS. 2-8, 10 and 12 show a drain box, generally designated 10, in accordance with a first preferred embodiment of the present invention. More specifically, the drain box 10 is a drop down drain box for improving the drainage of liquids, such as rain water, from a flat, or generally flat roof 50 of a building 52 or other structure. A low-slope, minimal slope, or slightly sloped roof, hereinafter a "generally flat roof," is defined herein as any roof susceptible to puddling or pooling of rain water, such as a slope of up to approximately ⅛ or ¼ of an inch per linear foot, for example. Although it is preferred and the drop down drain box of the present invention is particularly adapted for use with a flat or generally flat roof 50, the drain box 10 is not limited to being used with such roofs. Instead, the drain box 10 may be used with or on a variety of roofs of one or more buildings 52, support structures or enclosures, regardless of type, size or shape.

Referring to FIGS. 2-8, 10 and 12, the drain box 10 preferably includes a housing 12 designed to channel, direct or collect a liquid or fluid, such as rain water, or miscellaneous items, such as leaves, twigs, balls, debris or trash, to and into a top or open end 42*a* of a downspout 42. In the first preferred embodiment, the housing 12 may be formed of a single piece of sheet metal, such as copper or aluminum, for example, that is at least one of bent, folded, crimped or molded into a generally elongated, rectangular structure having a generally open top that preferably extends the entire length and width of the housing 12. Alternatively, the housing 12 may be formed of two or more initially separate and planar pieces that are at least one of welded, soldered, glued or crimped, for example, into a generally elongated, rectangular structure. However, the housing 12 is not limited to being elongated or rectangular in shape, as at least a portion of the housing 12 may be formed in virtually any shape, such as a concave shape. Further, the housing 12 is not limited to the inclusion of the generally open top that extends generally an entire longitudinal axis $A_L$ (i.e., length) (see FIG. 6) and lateral width (i.e., generally perpendicular to the longitudinal axis $A_L$) of the housing 12. However, an open top housing 12 does not limit the ways the rain water can enter the housing 12, for example.

Figure 10:
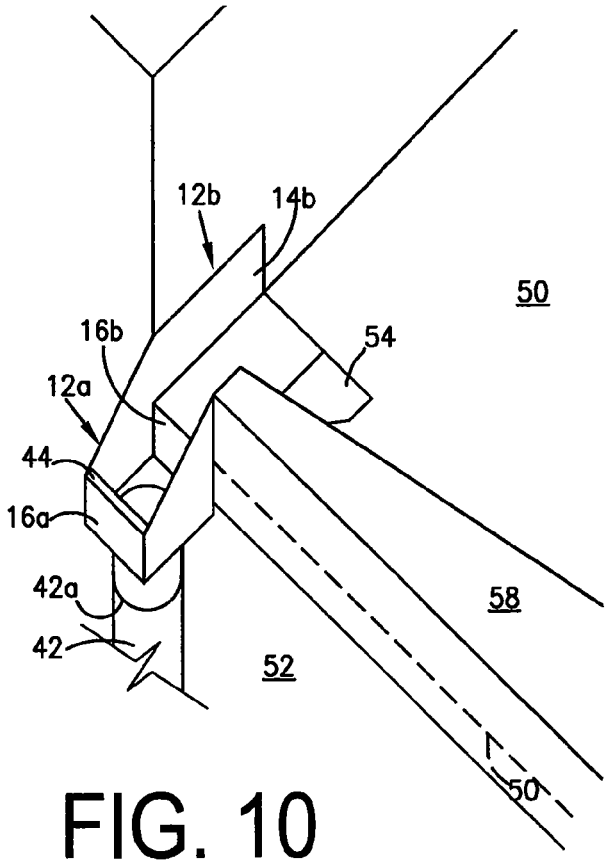
FIG. 10 is a right side isometric view of the drain box of FIG. 3 shown installed on a roof.
Figure 11:
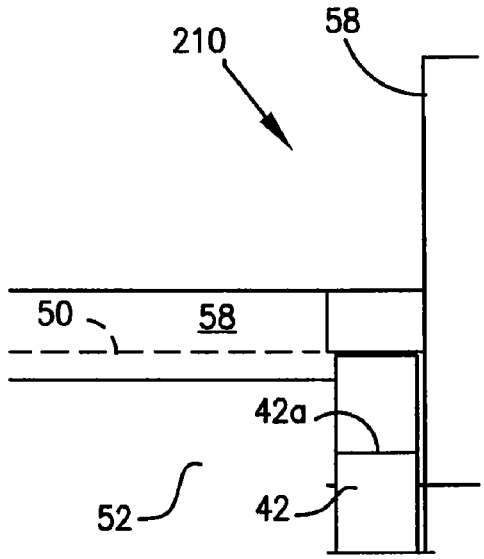
FIG. 11 PRIOR ART
FIG. 11 is a front elevation view of the prior art drain of FIGS. 1 and 9 shown installed on a roof.
Figure 12:
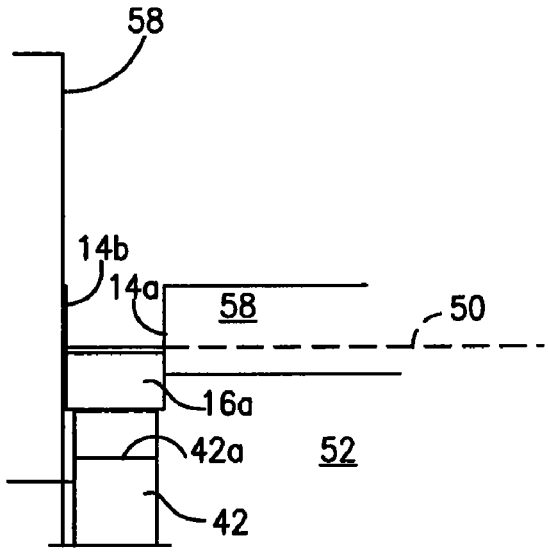
FIG. 12 is a front elevation view of the prior art drain box of FIGS. 3 and 10 shown installed on a roof.
Figure 13:
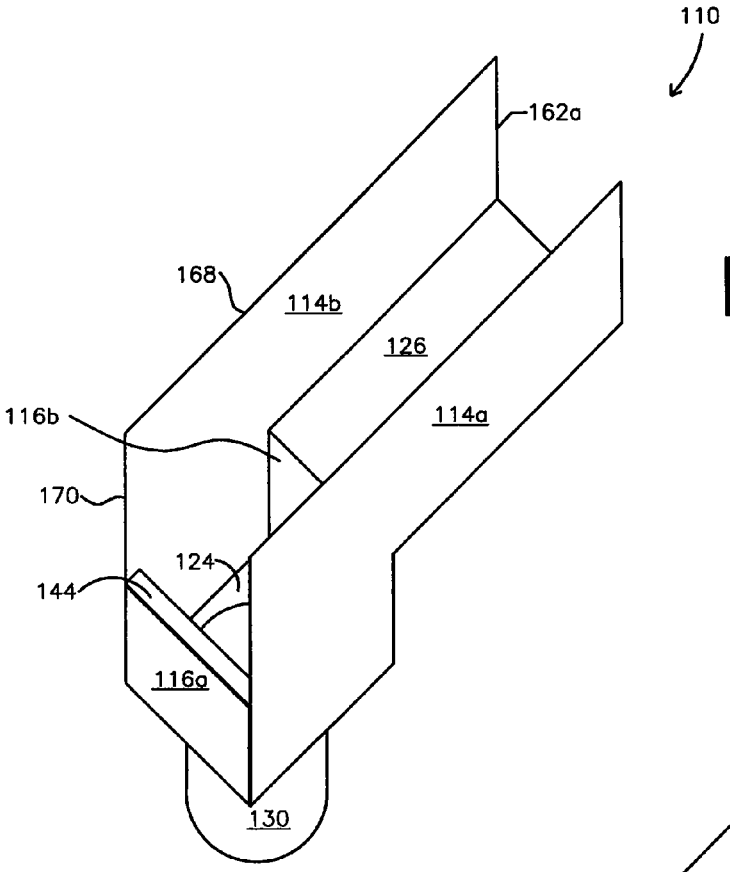
FIG. 13 is a front right isometric view of a drain box in accordance with a second preferred embodiment of the present invention.
Figure 14:
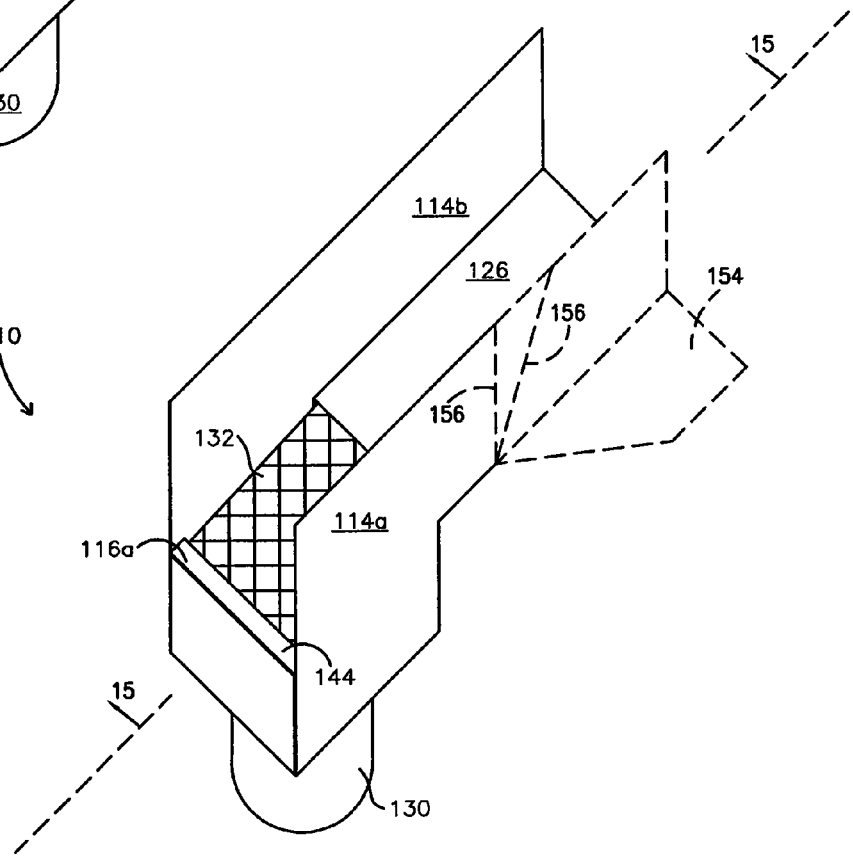
FIG. 14 is a front right isometric view of the drain box shown in FIG. 13, with a downspout guard located within a portion of the drain box and with a part of the drain box shown in phantom to identify possible relocation of the part.

More specifically, the housing 12 preferably includes a first portion 12*a* and a second portion 12*b* that is laterally adjacent to and preferably integrally and unitarily formed with the first portion 12*a*. While it is preferred that the first portion 12*a* is integrally and unitarily formed with the second portion 12*b*, the drain box 10 is not so limited, as the first and second portions 12*a*, 12*b* may be removably attached by one or more hinges, screws or nails (none shown), for example. As seen in FIGS. 10 and 12, the first portion 12*a* is preferably sized and shaped to be placed above or around at least a portion of the downspout 42, such as the top end 42*a* of the downspout 42, and the second portion 12*b* is preferably designed to initially receive the rain water (and any debris, for example) to be drained from the roof 50. It is preferred that a width of the first portion 12*a* is larger than a width or diameter of at least the top end 42*a* of the downspout 42. The second portion 12*b* preferably extends along a portion of the roof 50 spaced away from the top end 42*a* of the downspout 42.

Figure 5:
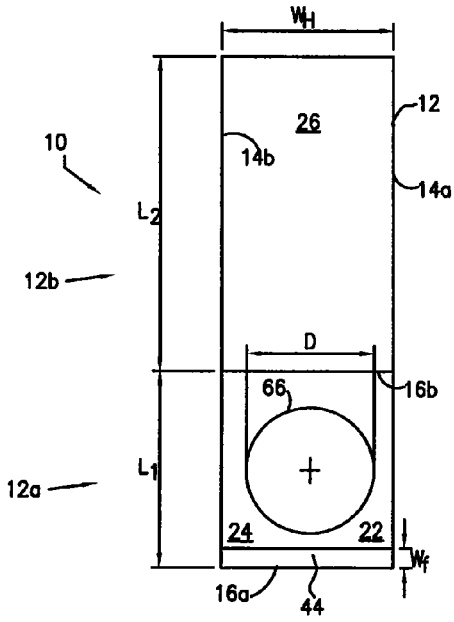
FIG. 5 is a top plan view of the drain box shown in FIG. 2.
Figure 6:
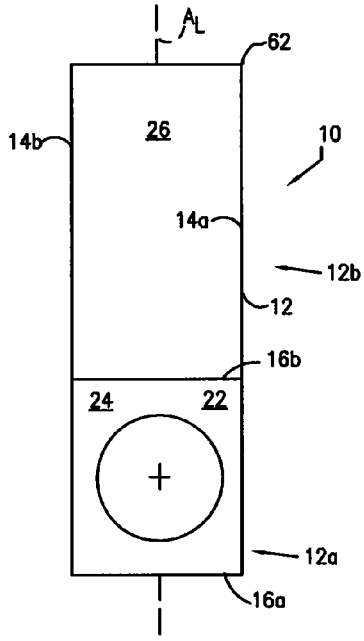
FIG. 6 is a bottom plan view thereof.
Figure 7:
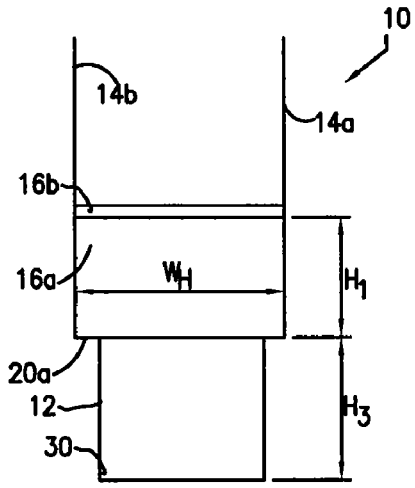
FIG. 7 is a front elevation view thereof.
Figure 8:
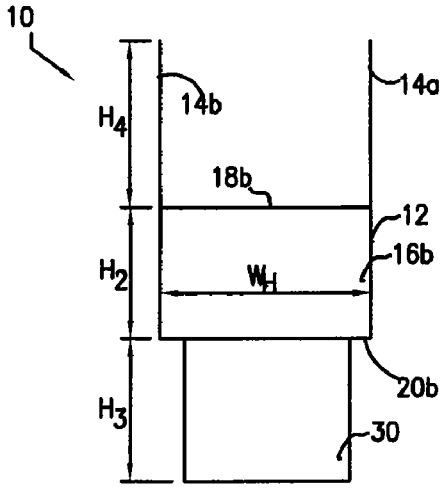
FIG. 8 is a rear elevation view thereof.
Figure 9:
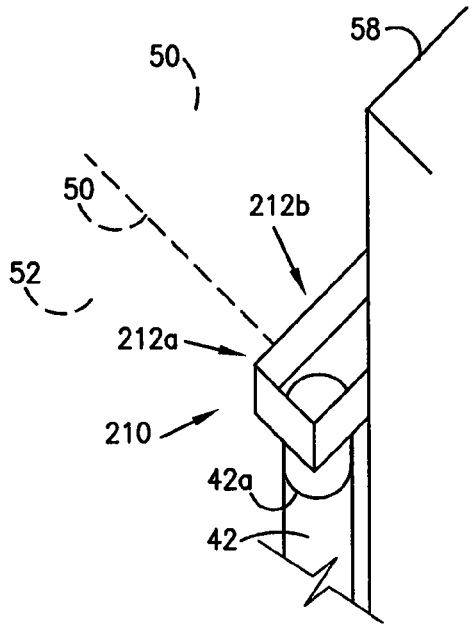
FIG. 9 PRIOR ART
FIG. 9 is a right side isometric view of the prior art drain box of FIG. 1 shown installed on a roof.

In the first preferred embodiment, the housing 12 includes a first or right side wall 14*a* and an opposing second or left side wall 14*b*. Each side wall 14*a*, 14*b* is preferably generally planar and defines a plane that extends in a direction that is generally parallel to and spaced a predetermined distance from a plane defined by the opposing side wall 14*a*, 14*b*. However, one or both sidewalls 14*a*, 14*b*, may be angled (not shown) toward the interior of the housing 12 to reduce or eliminate the top opening of the housing 12. As seen in FIGS. 5, 7 and 8, the preferred lateral width $W_H$ of the housing 12, or distance between the planes defined by the side walls 14*a*, 14*b* is approximately 4.375 inches. However, the lateral width $W_H$ of the housing 12 is not so limited.

As seen in FIGS. 2-4 and 10, it is preferred that the shape of each side wall 14*a*, 14*b*, when viewed from the side (see FIG. 4), is generally eccentric. Specifically, in the present embodiment, it is preferred that the portion of each side wall 14*a*, 14*b* that forms at least part of the first portion 12*a* of the housing 12 is generally angular or mitered, such that at least a front portion 68*a* of a top surface or edge 68 of each side wall 14*a*, 14*b* is angled or sloped, such as, but not limited to approximately a 45 degree angle. It is also preferred that a rear portion 68*b* of the top surface 68 of each side wall 14*a*, 14*b* is straight, linear or has the same height across the rear portion 68*b*. The mitered shape of at least the front portion 68*a* of the top surface 68 of each side wall 14*a*, 14*b* prevents excessive vibration of the housing 12 during strong winds when the drain box 10 is installed on a roof 50 and helps to prevent the housing 12 from being inadvertently blown off of the roof 50. However, the side walls 14*a*, 14*b* are not limited to the above-identified shape.

Further, the housing 12 preferably includes a first or front end wall 16*a* and an opposing second or rear end wall 16*b*. Each of the first and second end walls 16*a*, 16*b* preferably defines a plane that extends generally orthogonally between the first and second side walls 14*a*, 14*b*. Preferably, each end wall 16*a*, 16*b* is generally planar, and the planes defined by each end wall 16*a*, 16*b* are preferably spaced a predetermined distance apart and extend generally parallel to each other. Each end wall 16*a*, 16*b* preferably has a first or top edge 18*a*, 18*b* and an opposing second or bottom edge 20*a*, 20*b*. Opposing side edges of each end wall 16*a*, 16*b* are preferably unitarily formed with or securely attached in a water-tight manner to at least a portion of each side wall 14*a*, 14*b*.

In the present embodiment, a maximum rear length $L_2$ (FIGS. 4 and 5) of each side wall 14*a*, 14*b*, as measured between a rear edge 62 (FIGS. 4 and 6) of each side wall 14*a*, 14*b* and an imaginary line of demarcation 64 (FIG. 4) between the first and second portions 12*a*, 12*b* at the plane defined by the rear end wall 16*b* is preferably, but without limitation, approximately 8.25 inches. Further, a maximum front length $L_1$ (FIGS. 4 and 5) of each side wall 14*a*, 14*b*, as measured between the plane defined the front end wall 16*a* and the line of demarcation 64 between the first and second portions 12*a*, 12*b* is preferably, but without limitation, approximately 5.0625 inches. Further to the description provided above, the front portion 68*a* of the top surface 68 of each side wall 14*a*, 14*b* extends from the imaginary line of demarcation 64 to the front end wall 16*a*, and the rear portion 68*b* of the top surface 68 of each side wall 14*a*, 14*b* extends from the imaginary line of demarcation 64 to the rear edge 62 of the respective side wall 14*a*, 14*b*. A maximum height $H_1$ (FIGS. 4 and 7) of the front end wall 16*a*, as measured from the top edge 18*a* to the bottom edge 20*a*, is preferably, but without limitation, approximately 2.5 inches. A maximum height $H_2$ (FIGS. 4 and 8) of the rear end wall 16*b*, as measured from the top edge 18*b* to the bottom edge 20*b*, is preferably, but without limitation, approximately 2.75 inches.

It is preferred that the front end wall 16*a* has a shorter height that the rear end wall 16*b*, such that the top edge 18*a* of the front end wall 16*a* is preferably located vertically below the roof 50, when the drain box 10 is properly installed, to promote leaves, twigs or other debris to flow over the top edge 18*a* and not drop into an area defined between the front and rear end walls 16*a*, 16*b* and be caught there to block rain water from entering an opening 66 in the first section 24 of the bottom wall 22. Further, as described below, the shorter height of the front end wall 16*a* prevents excessive water from accumulating on the surface of the roof 50 in the event that the drain box 10, and particularly the opening 66, were to become clogged with leaves, twigs or other material or debris, for example. However, the housing 12 is not limited to the above-identified dimensions, as the size and shape of the drain box 10 may be modified depending upon the size of the roof or expected drainage needs of the building, for example.

Furthermore, the housing 12 preferably includes a generally planar bottom wall 22 that extends generally orthogonally from and between the side walls 14*a*, 14*b*, and between the first and second end walls 16*a*, 16*b*. The bottom wall 22 preferably includes a first section 24 proximate and extending from the bottom edges 20*a*, 20*b* of both the first and second end walls 16*a*, 16*b*, and a second section 26 proximate and extending rearwardly from the top edge 18*b* of the second end wall 16*b*. The first section 24 may alternatively be referred to herein as a bottom wall of the first portion 12*a* of the housing 12 and the second section 26 may be referred to as a bottom wall of the second portion 12*b* of the housing 12. In the first preferred embodiment, the end walls 16*a*, 16*b* and the first section 24 of the bottom wall 22 in combination with at least a segment or portion of each side wall 14*a*, 14*b* generally define a cavity 28 (FIG. 1). Alternatively, the cavity 28 is defined by the interior surfaces of the first portion 12*a* of the housing 12.

In the first preferred embodiment, when the drain box 10 is properly installed on a roof 50, the second section 26 of the bottom wall 22 is located above, and preferably in direct contact with the roof 50, where it is preferably fastened or secured to the roof, as by bonding with an asphaltic tar, mastic or the like. In contrast, the first section 24 of the bottom wall 22 is preferably located below the level of the roof 50 and extending beyond the side wall of the building or parapet 58. In other words, the first portion 12*a* of the housing 12 is substantially located below the plane defined by the roof 50 and the second portion 12*b* of the housing 12 is located entirely or substantially above the plane defined by the roof 50. The above structural feature of the drain box 10 of the present embodiment avoids the large accumulation of rain water that can occur when a conventional drain box 210 becomes clogged with leaves, twigs or debris, for example. Instead, even if the cavity 28 or the first portion 12*a* of the housing 12 becomes clogged or blocked, rain water will not accumulate on the roof 50, as the water will flow off of the roof over the top edge 18*a* of the front end wall 16*a*. Similarly, even if liquid within a portion of the downspout 42 freezes, melting snow, for example, can flow off of the roof 50 over the front end wall 16*a*. The front end wall 216*a* of a conventional drain box 210 prevents or restricts melting ice or snow from flowing off of the roof 50.

Alternatively or additionally, the bottom wall section 24 of the first portion 12*a* of the housing 12 extends in a direction generally parallel to and spaced a predetermined distance below the bottom wall of the second portion 26 of the housing 12. Thus, the bottom walls of the first and second portions 12*a*, 12*b* of the housing 12 preferably extend in a direction generally parallel to the plane defined by the roof 50. However, the drain box 10 is not limited to such a configuration.

Referring to FIGS. 2-5 and 10, the housing 12 preferably includes a flange 44 that extends generally orthogonally from the first or front end wall 16*a*, preferably adjacent the top edge 18*a* of the first end wall 16*a*, toward the second or rear end wall 16*a*. Preferably, the flange 44 extends in a direction generally parallel to and spaced a predetermined distance below the plane defined by the roof 50 or the plane defined the second section 26 of the bottom wall 22. It is preferred that the flange 44 is formed by bending, shaping or molding and therefore preferably is unitarily formed from at least a portion of the first end wall 16*a* proximate the top edge 18*a* thereof and extending preferably across the full width $W_H$ of the first portion 12*a* rearward within the cavity 28 or interior of the first portion 12*a*. However, the flange 44 may be formed from a separate piece of material, such as the preferred copper or aluminum used to make the drain box 10, or a separate and different type of material that may be attached to the front or first end wall 16*a*. The flange 44 may be preformed or otherwise constructed in a factory in advance of the installation of the drain box 10 or formed into place by a roofer during installation of the drain box 10 on a roof 50. A preferred maximum width $W_f$ (FIG. 5) of the flange 44, as measured along the longitudinal axis $A_L$ of the housing 12, is approximately 0.5 inch. Although it is preferred that the flange 44 extends the entire lateral width $W_H$ of the housing 12 such that a maximum length of the flange 44 is generally equal to the lateral width $W_H$ of the housing 12 and, therefore, approximately 4.375 inches, the flange 44 is not so limited.

Referring to FIGS. 2-4, 7 and 8, the drain box 10 includes a drainpipe portion 30 that extends downward from the housing 12. Specifically, it is preferred that the drainpipe portion 30 extends generally orthogonally downwardly from a bottom surface of the first section 24 of the bottom wall 22. Preferably, an upper portion of the drainpipe portion 30 surrounds the opening 66 in the first section 24 of the bottom wall 22 and at least a portion the drainpipe portion 30 is sized and shaped to fit within the open end 42*a* or surround at least the upper portion of the downspout 42. More specifically, it is preferred that the drainpipe portion 30 is generally circular in horizontal cross-section, although square and rectangular horizontal cross-sections are also typically used.

Preferably, both the opening 66 in the first section 24 of the bottom wall 22 and the drainpipe portion 30 generally have a diameter D (FIG. 5) of approximately 3.25 to approximately 3.5 inches, but the diameter D is not so limited. Further, it is preferred that an outer circumference or perimeter of the drainpipe portion 30, if the drainpipe portion 30 is square or rectangular, is at least slightly less than an inner circumference or perimeter of the downspout 42, such that the drainpipe portion 30 may fit relatively easily within the downspout 42. Specifically, it is preferred that the diameter D of the drainpipe portion 30 is approximately 0.25 inches smaller than a diameter of the downspout 42. Since the diameter of certain conventional downspouts 42 can be approximately 2, 3, 4 or 6 inches, the diameter D of drainpipe portion 30 may be approximately 1.75, 2.75, 3.75 or 5.75 inches, respectively. A maximum height $H_3$ (FIGS. 4, 7 and 8) of the drainpipe portion 30 is preferably approximately 3 inches, but the drainpipe portion 30 height is not so limited. A maximum height $H_4$ (FIGS. 4 and 8) of the rear edge 62 of each side wall 14*a*, 14*b*, and thus the maximum height of each side wall 14*a*, 14*b*, is preferably approximately 3.5 inches, but each side wall 14*a*, 14*b* is not so limited.

Figure 3:
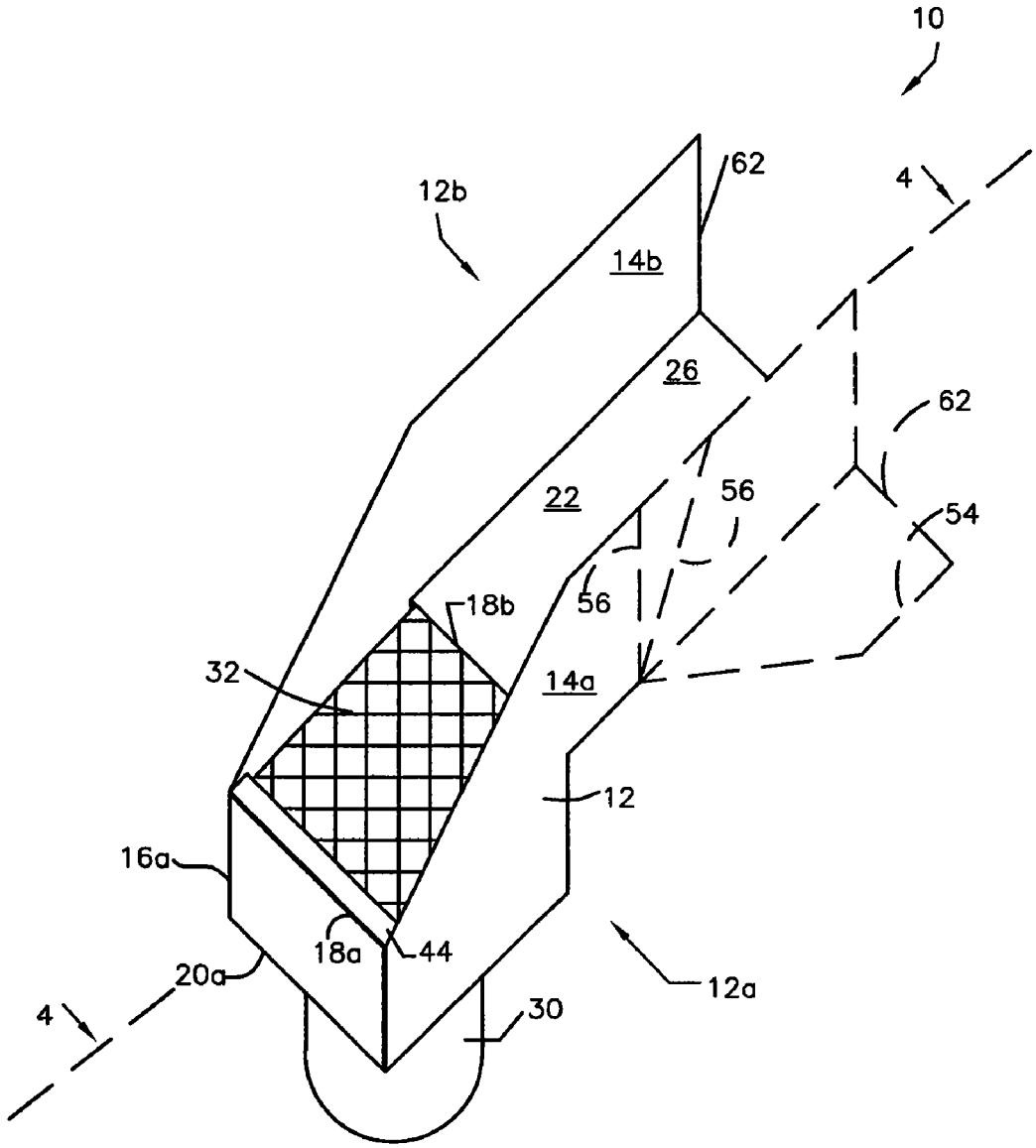
FIG. 3 is a front right isometric view of the drain box shown in FIG. 2, with a downspout guard located within a portion of the drain box and with a part of the drain box shown in phantom to identify possible relocation of the part.
Figure 4:
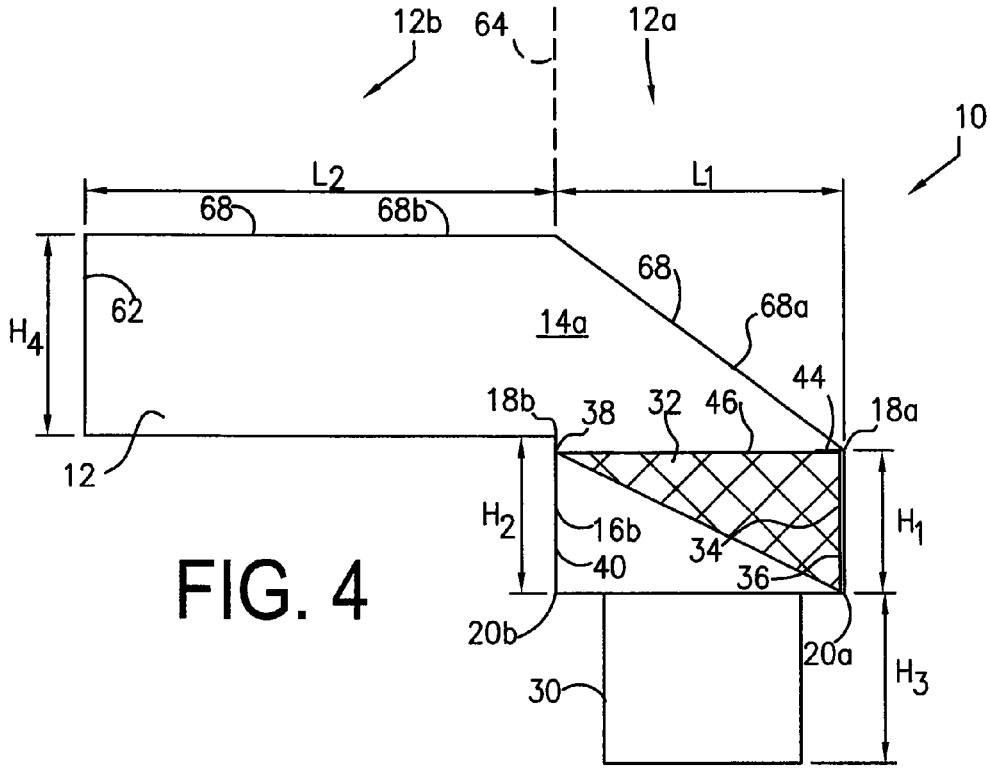
FIG. 4 is a cross-sectional elevation view of the drain box shown in FIG. 3, taken along line 4-4 of FIG. 3.

Referring to FIGS. 3 and 4, the drain box 10 preferably includes a downspout guard 32 located within the cavity 28. In the first preferred embodiment, the downspout guard 32 is formed of a water-porous material, such as a mesh or mesh-like material, such as or similar to that sold as Gutter Stuff® foam filter material by TMJ Innovations, LLC, and as described in U.S. Pat. No. 7,208,081. The water-porous material may be formed of a polyether or other synthetic plastic open cell foam, typically having a cell size of about 10 to about 20 cells per square inch. The phrase "water-porous material" is defined herein as readily allowing water to pass therethrough, but preventing the passage of generally solid materials, such as any or all of leaves, twigs, debris or soil. Preferably, the downspout guard 32 is formed entirely of the water-porous material and is inserted into the cavity 28. However, only a portion of the downspout guard 32 may be formed of the water-porous material. Further, the downspout guard 32 preferably extends generally from the segment of the first side wall 14*a* to the segment of the second side wall 14*b* that define the cavity 28 and from an interior surface 36 of the first end wall 16*a* to an interior surface 40 of the second end wall 16*b*.

In the first preferred embodiment, downspout guard 32 is in the shape of a triangle when viewed either the left or right sides (see FIG. 4). Preferably, the downspout guard 30 includes a generally planar front surface 34 (FIG. 4) that engages generally the entire interior or inwardly-facing surface 36 of the first end wall 16*a*. The downspout guard 32 further preferably includes a rear surface or edge 38 (FIG. 4) that engages at least a portion of the interior or inwardly-facing surface 40 of the second end wall 16*b*. The above-identified shape of the downspout guard 32 has been found to maintain rigidity while allowing liquid to readily flow through the cavity 28. However, the downspout guard 32 is not limited to the exact size and shape described herein, as the downspout guard 32 may be formed in any one of a variety of sizes and shapes designed to prevent the flow of leaves, twigs or debris, for example, from flowing to and through the top end 42*a* of the downspout 42. For example, the downspout guard 32 may be generally planar, having a uniform thickness throughout. In such an embodiment, a ledge (not shown) may be located on the interior surface 36 of the front end wall 16*a* proximate the bottom edge 20*a* thereof to support the downspout guard 32 in an angled position within the cavity 28.

To assure that the downspout guard 32 is held in a proper position, it is preferred that a silicone adhesive, for example, is applied to at least a portion of the rear surface 38 of the downspout guard 32 or to at least a portion of the inwardly-facing surface 40 of the second end wall 16*b*. While it is preferred that adhesive is not applied to the front surface 34 of the downspout guard 32 or the inwardly-facing surface 36 of the front end wall 16*a*, the drain box 10 is not so limited. As seen in FIGS. 3 and 4, the downspout guard 32 is preferably entirely located within the cavity 28 and the top surface 46 of the downspout guard 32 preferably occupies an entire cross-sectional area of the cavity 28 after proper installation. More specifically, it is preferred that the entire downspout guard 32 is located beneath the flange 44. However, the drain box 10 is not so limited, as at least a portion of the downspout guard 32 may extend upwardly beyond a plane defined by the flange 44. For example, it is preferred that at least a portion of a generally planar top surface 46 (FIG. 4) of the downspout guard 32 is in facing engagement with a bottom or inwardly surface of the flange 44. Thus, the downspout guard 32 is preferably wedged into the first portion 12*a* of the housing 12.

Figure 2:
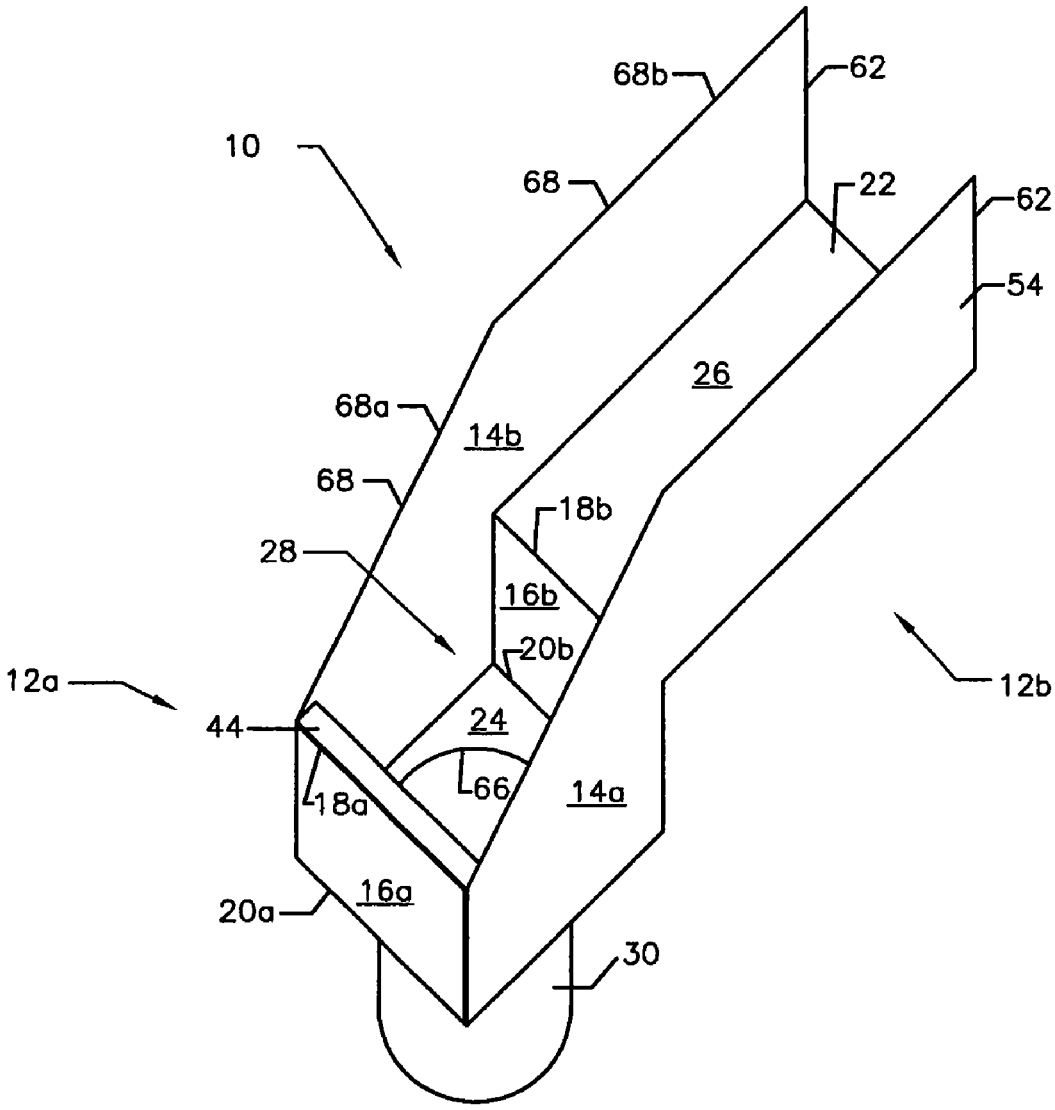
FIG. 2 is a front right isometric view of a drain box in accordance with a first preferred embodiment of the present invention.

Referring to FIGS. 2, 3 and 10, it is preferred that a predetermined part 54 of at least one of the first and second side walls 14*a*, 14*b* is cut, folded, bent or formed, for example, such that it extends in a direction generally parallel to the plane defined by the second section 26 of the bottom wall 22 of the housing 22. Relocation of the predetermined part 54 from the original (vertical) position (FIG. 2) to the modified (horizontal) position (FIG. 10) is designed to encourage rain water to flow into the interior of the housing 12 and eventually down the down downspout 42. More specifically, a line 56, which may be scored, for example, may be formed in at least a portion of either or both the first and second side walls 14*a*, 14*b*, which preferably defines one end of the predetermined part 54. The line 56 (two different embodiments thereof shown in FIG. 3) preferably defines a location to guide a manufacturer, distributor or roofer, for example, where to cut the side wall 14*a* or 14*b*, if desired, to allow a rear portion of either or both side walls 14*a*, 14*b*, to be bent or folded along the edge between the side wall 14*a*, 14*b* and the second section 26 of the bottom wall 22 so that the predetermined part 54 can be in a horizontal or near-horizontal position (FIG. 10) on the flat or generally flat roof 50. However, the drain box 10 is not limited to the inclusion of the predetermined part 54 or the line 56, and the predetermined part 54 may be originally manufactured in the horizontal position (FIG. 10) instead of the vertical position (FIG. 2).

Referring to FIGS. 13-16, a second preferred embodiment of the drain box 110 is shown, wherein like referenced numerals are utilized to indicate like elements throughout the several views. The reference numerals of the second preferred embodiment are distinguishable from those of the first preferred embodiment by a factor of one hundred (100), but otherwise indicate the same elements as in the first preferred embodiment, except as otherwise specified. The drain box 110 of the second preferred embodiment is substantially similar to that of the first preferred embodiment. For example, the drain box 110 includes a housing 112 having a first and second portion 112*a*, 112*b* generally distinguishable an imaginary line of demarcation 164 that extends generally coplanar with a plane defined by a second or rear end wall 116*b*. Further, the housing 112 preferably includes a first or right side wall 114*a*, a second or left side wall 114*b*, a first or front end wall 116*a* and a bottom wall 122 having a first section 124 that defines a plane that extends generally parallel to but spaced apart from (i.e., not coplanar with) a plane defined by a second section 126. A flange 144 preferably extends above a portion of a downspout guard 132 located in a cavity 128 of the first portion 112*a* of the housing 112. A line 156 (two embodiments shown in FIG. 14) preferably defines one end of the predetermined part 154 Additional similarities between the first and second preferred embodiments are omitted herein for the sake of brevity and convenience and are not limiting.

A primary difference between the first and second preferred embodiments is that the second preferred embodiment includes a top surface or edge 168 of each side wall 114*a*, 114*b* that defines the first portion 112*a* of the housing 112 is generally straight, linear or coplanar with the top surface or edge 168 of each side wall 114*a*, 114*b* that defines the second portion 112*b*. In other words, it is preferred that the entire top edge 168 of each side wall 114, 114*b*, which is comprised of a first or front portion 168*a* and a second or rear portion 168*b*, extends generally parallel with the plane defined by the roof 50. The drain box 110 of the second preferred embodiment can be manufactured to a particular size or shape to fit any opening or cavity formed by the design of the roof 50, such as a laterally-extending opening in the parapet wall 58.

Figure 15:
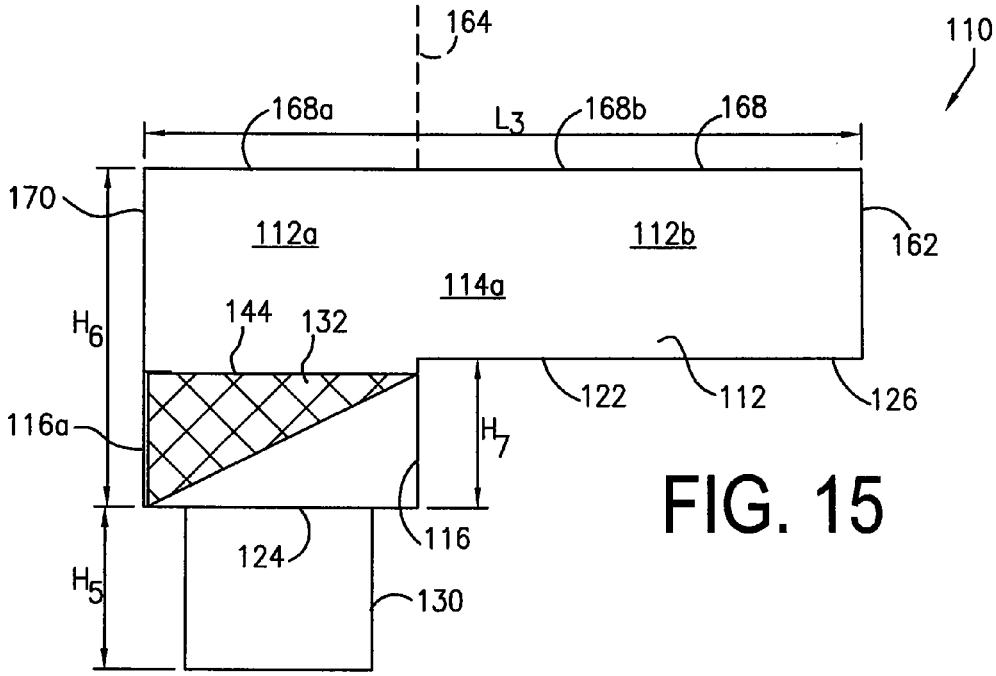
FIG. 15 is a cross-sectional elevation view of the drain box shown in FIG. 14, taken along line 15-15 of FIG. 14.
Figure 16:
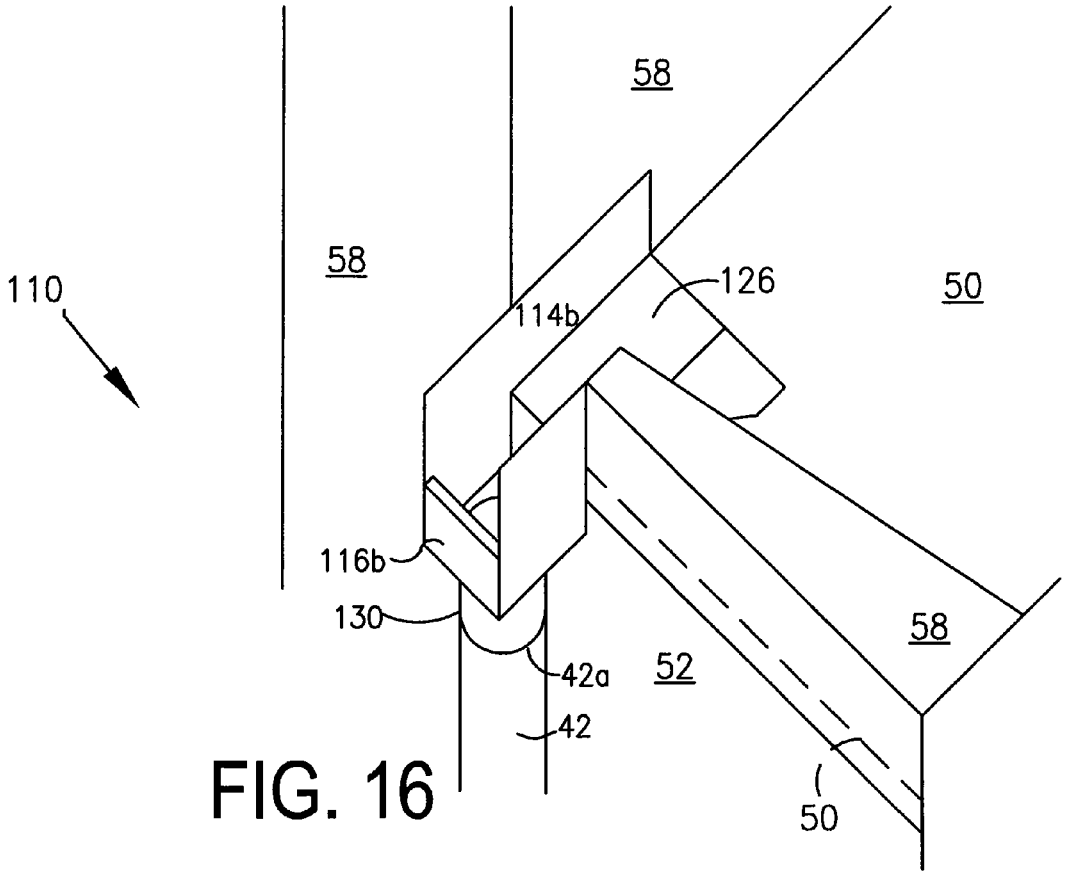
FIG. 16 is a right side isometric view of the drain box of FIG. 13 shown installed on a roof.

Referring to FIG. 15, a maximum height $H_6$ of both the first and second side walls 114*a*, 114*b*, as measured from the plane defined by the first section 124 of the bottom wall 122 to the top edge 168 of each side wall 114, 114*b*, is preferably approximately 6.25 inches. A maximum height $H_7$ of the rear end wall 116*b*, as measured from a plane defined by the second section 126 of the bottom wall 122 to the plane defined by the first section 124 of the bottom wall 122, is preferably approximately 2.75 inches, which is preferably equal to the height $H_2$ of the first preferred embodiment. A maximum height $H_5$ of a drainpipe portion 130 of the housing 112 is preferably approximately 3 inches, which is preferably equal to the height $H_3$ of the first preferred embodiment. Further, a maximum length $L_3$ of each side wall 114*a*, 114*b* (and, thus, the entire drain box 110), as measured between a rear edge 162 of each side wall 114*a*, 114*b* and a front edge 170 of each side wall 114*a*, 114*b*, is preferably approximately 13.3125 inches, which is preferably equal to the sum of the lengths $L_1$ and $L_2$ of the first preferred embodiment. However, the housing 112 is not limited to the above-identified dimensions or shapes. For example, the housing 112 may have a length $L_3$ of approximately 12 inches, a width of approximately 4.5 inches and a total height of approximately 3.5 inches.

A method of making the drain box 10, 110 of the first and second preferred embodiments preferably includes forming the housing 12, 112 including the first side wall 14*a*, 114*a* and the opposing second side wall 14*b*, 114*b*, the first end wall 16*a*, 116*a* and the opposing second end wall 16*b*, 116*b* that extends generally orthogonally between the first and second side walls 14*a*, 14*b*, 114*a*, 114*b*, and the bottom wall 22, 122. It is preferred that each end wall 16*a*, 16*b*, 116*a*, 116*b* has the top edge 18*a*, 18*b*, 118*a*, 118*b* and opposing bottom edge 20*a*, 20*b*, 120*a*, 120*b*, as described in detail above. It is also preferred that the bottom wall 22, 122 extends generally orthogonally between the first and second side walls 14*a*, 14*b*, 114*a*, 114*b* and includes the first section 24, 124 that extends from the bottom edge 20*b*, 120*b* of the second end wall 16*b*, 116*b* and the second section 26, 126 that extends from the top edge 18*b*, 118*b* of the second end wall 16*b*, 116*b*.

The method further preferably includes inserting the downspout guard 32, 132 into the cavity 28, 128 of the housing 12, 112. It is preferred that the flange 44, 144 is formed such that it extends generally orthogonally from the top edge 18*a*, 118*a* of the first end wall 16*a*, 116*a* and that the entire downspout guard 32, 132 is inserted into the cavity 28, 128 such that it is entirely beneath a plane defined by the flange 44, 144. The method also preferably includes forming a drainpipe portion 30, 130 that extends downwardly from a bottom surface of the first section 24, 124 of the bottom wall 22, 122, placing at least the second section 26, 126 of the bottom wall 22, 122 of the housing 12, 112 on top of at least a portion of the roof 50 of the building 52; and placing at least a portion of the drainpipe portion 30, 130 within at least a portion of the downspout 42 of the building 52.

It is also preferred that the method of making the drain box 10, 110 includes bending the predetermined part 54, 154 of at least one of the first and second side walls 14*a*, 14*b*, 114*a*, 114*b* to extend in a direction generally parallel to the plane defined by the second section 26, 126 of the bottom wall 22, 122 of the housing 12, 112 so as to encourage rain water to flow into the interior of the housing 12, 112. The step of bending a predetermined part 54, 154 of either or both of the first and second side walls 14*a*, 14*b*, 114*a*, 114*b* may occur before or after the second section 26, 126 of the bottom wall 22, 122 of the housing 12, 112 is placed on top of the roof 50 of the building 52.

It will be appreciated by those skilled in the art that changes could be made to the embodiments and method(s) described above without departing from the broad inventive concept thereof. It is understood, therefore, that this invention is not limited to the particular embodiments and method(s) disclosed, but it is intended to cover modifications within the spirit and scope of the present invention as defined by the appended claims.

I claim:

1. A drain box comprising:

a housing including:

a first side wall and an opposing second side wall;

a first end wall and an opposing second end wall, each end wall extending generally orthogonally between the first and second side walls, each end wall have a top edge and an opposing bottom edge; and a bottom wall extending generally orthogonally between the first and second side walls, the bottom wall including:

a first section extending from the bottom edge of the second end wall; and a second section extending from the top edge of the second end wall;

the end walls and the first section of the bottom wall in combination with at least a segment of each side wall generally defining a cavity;

a drainpipe portion extending downwardly generally orthogonally away from the first section of the bottom wall; and a downspout guard located within the cavity, wherein the second section of the bottom wall of the housing is located above a flat or generally flat roof of a building and the first section of the bottom wall of the housing is located below the roof of the building.

2. The drain box according to claim 1, wherein the drainpipe portion is generally circular in cross-section and is sized and shaped to fit within at least a portion of a downspout.

3. The drain box according to claim 1, wherein the downspout guard is formed of a water-porous material that extends generally from the segment of the first side wall to the segment of the second side wall and from the first end wall to the second end wall.

4. The drain box according to claim 3, wherein the downspout guard includes a generally planar front surface that engages an inwardly-facing surface of the first end wall.

5. The drain box according to claim 1, wherein the downspout guard is entirely located within the cavity.

6. The drain box according to claim 1, wherein the housing further includes a flange that extends generally orthogonally from the top edge of the first end wall toward the second end wall and wherein the downspout guard is located beneath the flange.

7. The drain box according to claim 6, wherein the flange extends in a direction generally parallel to and below a plane defined by the roof of the building.

8. The drain box according to claim 1, wherein a predetermined part of at least one of the first and second side walls extends in a direction generally parallel to a plane defined by the second section of the bottom wall to encourage rainwater to flow into the housing.

9. The drain box according to claim 1, wherein at least a portion of a top edge of each side wall is sloped to a top edge of the first end wall.

10. A drain box comprising:

a housing including:

a first side wall and an opposing second side wall;

a first end wall and an opposing second end wall, each end wall extending generally orthogonally between the first and second side walls, each end wall have a top edge and an opposing bottom edge; and a bottom wall extending generally orthogonally between the first and second side walls, the bottom wall including:

a first section extending from the bottom edge of the second end wall; and a second section extending from the top edge of the second end wall;

the end walls and the first section of the bottom wall in combination with at least a segment of each side wall generally defining a cavity;

a drainpipe portion extending downwardly generally orthogonally away from the first section of the bottom wall; and a downspout guard located within the cavity, the downspout guard being formed of a water-porous material extending generally from the segment of the first side wall to the segment of the second side wall and from the first end wall to the second end wall, the downspout guard including a generally planar front surface that engages an inwardly-facing surface of the first end wall, wherein the downspout guard includes a rear surface that engages at least a portion of an inwardly-facing surface of the second end wall.

11. A drain box comprising:

a housing including:

a first portion generally defining a cavity and having a flange that extends generally orthogonally inwardly into an interior of the first portion, the first portion being sized and shaped to be placed above at least a portion of a downspout; and a second portion laterally adjacent to the first portion, the second portion having a bottom wall extending along a portion of a generally flat roof of a building; and a downspout guard located within the cavity, the downspout guard is formed of a water-porous material located entirely within the first portion of the housing, wherein at least a portion of the water-porous material is located beneath the flange, wherein a bottom wall of the first portion extends in a direction generally parallel to and spaced a predetermined distance below the bottom wall of the second portion.

12. The drain box according to claim 11, wherein the entire downspout guard is located below a plane defined by the bottom wall of the second portion of the housing.

13. A drain box comprising:

a housing including:

a first portion generally defining a cavity and having a flange that extends generally orthogonally inwardly into an interior of the first portion, the first portion being sized and shaped to be placed above at least a portion of a downspout; and a second portion laterally adjacent to the first portion, the second portion having a bottom wall extending along a portion of a generally flat roof of a building; and a downspout guard located within the cavity, the downspout guard is formed of a water-porous material located entirely within the first portion of the housing, wherein at least a portion of the water-porous material is located beneath the flange, wherein the bottom walls of the first and second portions extend in a direction generally parallel to the roof, and wherein the bottom wall of the first portion is spaced a predetermined distance below the bottom wall of the second portion.

14. A method of making a drain box comprising:

forming a housing including:

a first side wall and an opposing second side wall;

a first end wall and an opposing second end wall, each end wall extending generally orthogonally between the first and second side walls, each end wall have a top edge and an opposing bottom edge; and a bottom wall extending generally orthogonally between the first and second side walls, the bottom wall including:

a first section extending from the bottom edge of the second end wall; and a second section extending from the top edge of the second end wall;

the end walls and the first section of the bottom wall in combination with at least a segment of each side wall generally defining a cavity;

inserting a downspout guard into the cavity;

forming a drainpipe portion that extends downwardly from a bottom surface of the first section of the bottom wall;

placing at least the second section of the bottom wall of the housing on to of at least a portion of a flat or generally flat roof of a building; and placing at least a portion of the drainpipe portion within at least a portion of a downspout of the building.

15. The method according to claim 14, further comprising:

bending a predetermined part of at least one of the first and second side walls to extend in a direction generally parallel to a plane defined by the second section of the bottom wall so as to encourage rain water to flow into the housing.

16. The method according to claim 14, further comprising:

forming a flange that extends generally orthogonally from the top edge of the first end wall; and inserting the entire downspout guard beneath a plane defined by the flange.

* * * * *